US009821889B2

(12) United States Patent
O'Neal

(10) Patent No.: US 9,821,889 B2
(45) Date of Patent: Nov. 21, 2017

(54) BOAT SEAT ACCESSORY STAND

(71) Applicant: James E. O'Neal, Marietta, GA (US)

(72) Inventor: James E. O'Neal, Marietta, GA (US)

( * ) Notice: Subject to any disclaimer, the term of this patent is extended or adjusted under 35 U.S.C. 154(b) by 0 days.

(21) Appl. No.: 15/430,004

(22) Filed: Feb. 10, 2017

(65) Prior Publication Data

US 2017/0225752 A1 Aug. 10, 2017

Related U.S. Application Data

(60) Provisional application No. 62/293,347, filed on Feb. 10, 2016.

(51) Int. Cl.

| | |
|---|---|
| ***B63B 17/00*** | (2006.01) |
| ***B63B 29/06*** | (2006.01) |
| *B63B 29/04* | (2006.01) |

(52) U.S. Cl.
CPC ..... *B63B 29/06* (2013.01); *B63B 2029/043* (2013.01)

(58) Field of Classification Search
CPC ..... B63B 29/06
See application file for complete search history.

(56) References Cited

U.S. PATENT DOCUMENTS

| | | | | |
|---|---|---|---|---|
| 4,318,567 A * | 3/1982 | Guthier | A47C 15/004 | 135/16 |
| 4,645,167 A * | 2/1987 | Hardwick | B63B 29/04 | 248/283.1 |
| 9,555,862 B1 * | 1/2017 | Sutherland | B63B 27/00 | |
| 2016/0018045 A1 * | 1/2016 | Blackburn | B25J 9/08 | 239/722 |

* cited by examiner

*Primary Examiner* — Stephen Avila
(74) *Attorney, Agent, or Firm* — Jones IP Law, LLC; Dennis W. Jones

(57) ABSTRACT

A boat seat accessory stand includes a main support member, a sleeve member, a lower brace member, and an upper brace member for attaching an umbrella or other accessory to a typical pedestal mount boat seat. The boat seat accessory stand provides for support and rotation of the attached umbrella around the boat seat.

9 Claims, 8 Drawing Sheets

BOAT SEAT ACCESSORY STAND

CROSS-REFERENCE TO RELATED APPLICATIONS

This application claims the benefit of U.S. Provisional Application No. 62/293,347, entitled "Boat Seat Accessory Assembly," filed Feb. 10, 2016, which is incorporated herein by reference as if set forth herein in its entirety.

BACKGROUND

This invention pertains to boat seats. More particularly, this invention pertains to a boat seat accessory stand that is attachable to a boat seat support structure to provide for attaching an umbrella or other accessories for use with the boat seat.

BRIEF SUMMARY

According to one embodiment of the present invention, a boat seat accessory stand that includes a main support member, a sleeve member, a lower brace member, and an upper brace member for attaching an umbrella or other accessory to a typical pedestal mount boat seat, is provided. The boat seat accessory stand provides for support and rotation of the attached umbrella around the boat seat. An umbrella is attachable to the boat seat accessory stand frame for providing shade when fishing in bright sun, rain, or hot weather.

In one embodiment, a pedestal mount of a typical pedestal mount boat seat extends through the sleeve of the boat seat accessory stand and is attached to a boat deck in a typical mounting fashion.

According to one embodiment, the main support member and the sleeve member are hollowed out tubular or cylindrical structures, while the lower brace member and the upper brace member are hexagonal structures extending between the main support member and the sleeve member and provide a lighter weight structure that is easily attached or detached from a typical boat seat.

In another embodiment, the boat seat accessory stand is adapted for securing a tray within reach of a fisherman or occupant of the boat seat.

In one embodiment, the boat seat accessory stand is a one piece or single structure that includes the main support member, the sleeve member, the lower brace member, and the upper brace member.

In another embodiment, the boat seat accessory stand is assembled from various and/or separate pieces. That is, the main support member, the sleeve member, the lower brace member, and the upper brace member may all be separate pieces that are attached or welded together.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE DRAWINGS

The above-mentioned features will become more clearly understood from the following detailed description read together with the drawings in which:

FIG. 2-B is a perspective view of the boat seat accessory stand;

FIG. 3-B is a side view of the boat seat accessory stand;

DETAILED DESCRIPTION

A boat seat accessory stand for a boat seat that provides for attaching an umbrella and/or other accessories to a boat seat support structure is disclosed. An umbrella is attachable to the boat seat accessory stand frame for providing shade when fishing in rain, bright sun, or hot weather.

Figure 1:
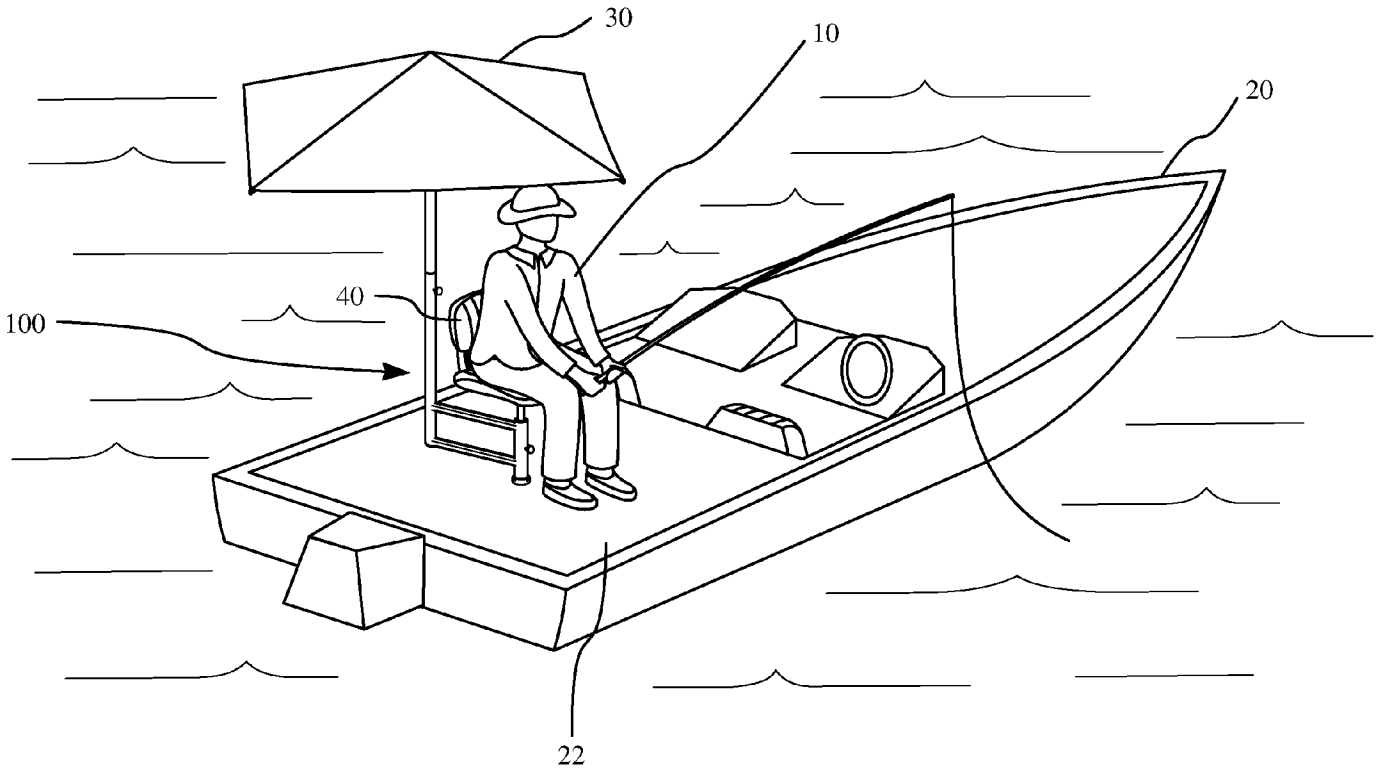
FIG. 1 is a perspective view illustrating a fisherman using the boat seat accessory stand with an attached umbrella.

FIG. 1 is a perspective view illustrating a fisherman 10 seated in a boat seat 40 of a boat 20 using the boat seat accessory stand 100 with an attached umbrella 30. The fisherman 10 is shown seated in a boat seat 40 utilizing a boat seat accessory stand 100. The boat seat accessory stand 100 is attached to a boat seat 40 on a raised boat deck 22 at the rear of the boat 20. The umbrella 30 provides for shade when fishing in sunny conditions, or shelter when fishing in rainy conditions, for example.

In the illustrated embodiment, the boat seat accessory stand 100 provides for attaching an umbrella to the boat seat accessory stand 100 for use with the boat seat 40. It should be noted that the boat seat accessory stand 100 is adaptable for other type accessories where the convenience of rotating the accessory around the boat seat 40 is desirable. For example, the boat seat accessory stand 100 could also be adapted for securing a tray or tackle box within reach of a fisherman 10 or occupant of the boat seat 40. It should be apparent that many other uses and/or accessories can be attached to the boat seat accessory stand 100.

Figure 2:
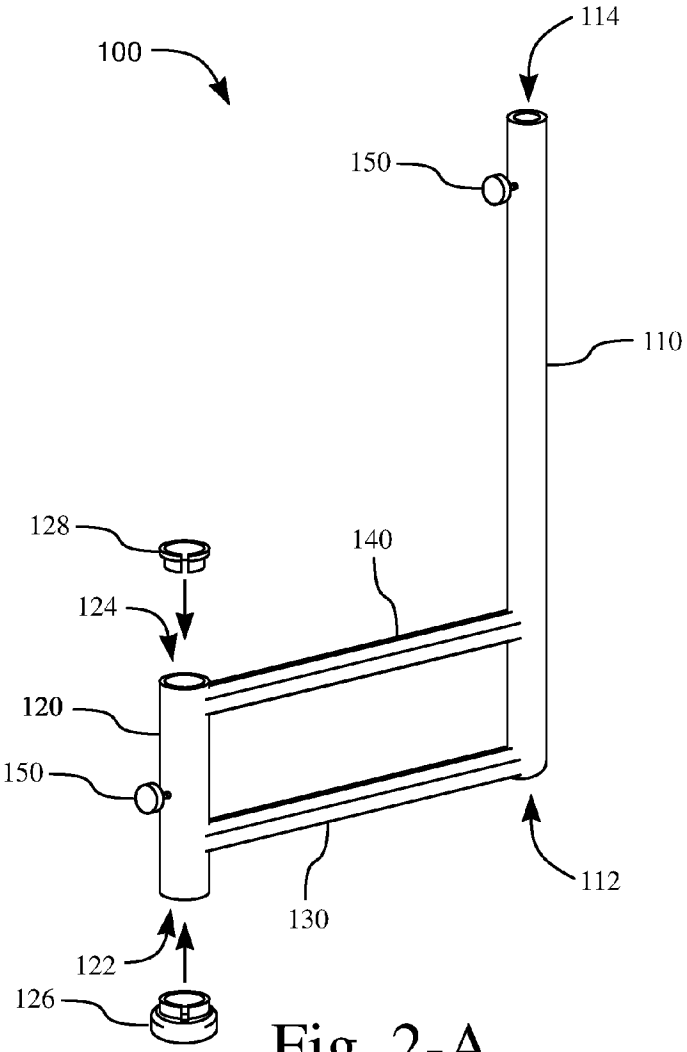
FIG. 2-A is a partially exploded perspective view of the boat seat accessory stand.
Figure 3:
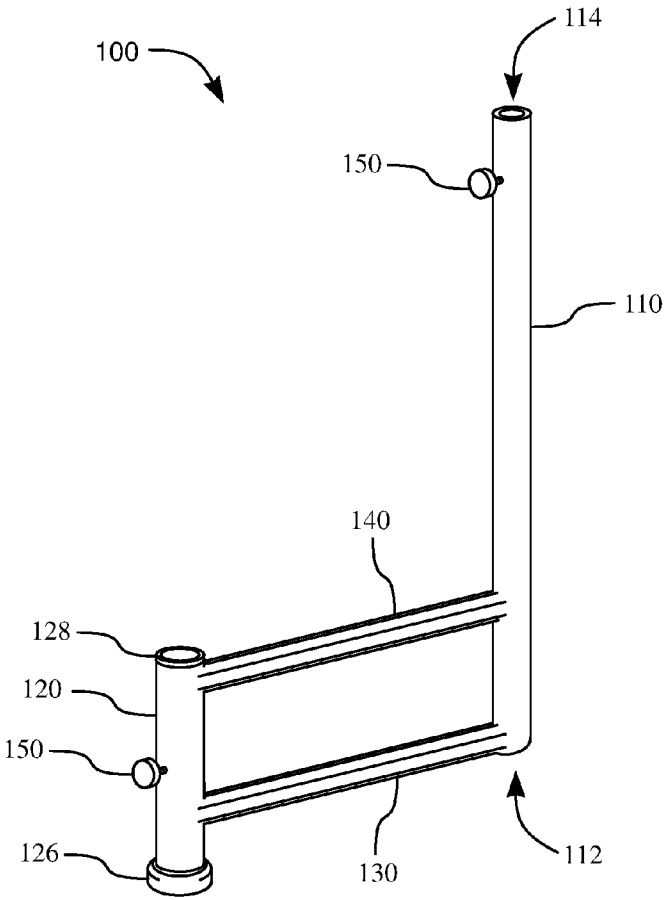
FIG. 3-A is a partially exploded side view of the boat seat accessory stand.

FIG. 2-A is a partially exploded perspective view of the boat seat accessory stand 100, and FIG. 2-B is a perspective view of the boat seat accessory stand 100. FIG. 3-A is a partially exploded side view of the boat seat accessory stand 100, and FIG. 3-B is a side view of the boat seat accessory stand 100. In the illustrated embodiment, the boat seat accessory stand 100 includes a frame structure formed from a main support member 110, a sleeve member 120, a lower brace member 130, and an upper brace member 140.

In various embodiments, the one piece structure, that is, the main support member 110, the sleeve member 120, the lower brace member 130, and the upper brace member 140, are assembled as a single piece from aluminum, stainless steel, steel, galvanized steel, plastic, or other suitable materials that provide the strength, rigidity, and durability necessary for a solid structure to provide support for an umbrella 30 or any other accessories to be utilized with the boat seat accessory stand 100. It should be noted that many materials are suitable for providing the strength, rigidity, and durability of the structure while maintaining the ability to attach an umbrella 30 or other type accessory for use with the boat seat 40.

In the illustrated embodiment, the main support member 110 and the sleeve member 120 are hollowed out tubular or cylindrical structures. The lower brace member 130, and the upper brace member 140 are hollowed out hexagonal structures. The hexagonal structures of the lower brace member 130 and the upper brace member 140 provide for greater strength in the horizontal support between the vertical cylindrical structures of the main support member 110 and the sleeve member 120. A hollow assembly provides a lighter weight structure that is more easily attached to or detached from a typical boat seat 40. One typical boat seat 40 is a pedestal mounted seat that is attachable and removable from a raised boat deck 22 as in the illustrated embodiment of FIG. 1 above.

In one embodiment, the sleeve member 120 of the boat seat accessory stand 100 includes a lower sleeve opening 122 and an upper sleeve opening 124. The sleeve member 120 is of tubular construction and includes a cylindrical opening along its length that provides for the pedestal of a pedestal type boat seat stand to extend through the inside of the sleeve member 122. The pedestal type boat seat stand extends through the sleeve member 122 and secures to the raised deck 22 of a boat.

In one embodiment, the sleeve member 120 is a hollow, tubular member so that the sleeve member 120 of the boat seat accessory stand 100 slides over the pedestal mount of a typical boat seat 40 as the boat seat 40 is attached to the raised boat deck 22. That is, installation of the boat seat accessory stand 100 simply requires one to remove the boat seat 40 from the deck 22 of the boat 20, insert the pedestal mount of the boat seat 40 through the sleeve member 120 of the boat seat accessory stand 100, and then attach the pedestal mount of the boat seat 40 to the deck 22 of the boat 20.

In the illustrated embodiment, the sleeve member 120 includes a spacer 126 and a bushing 128. The spacer 126 is partially inserted into the lower sleeve opening 122 of the sleeve member 120. The spacer 126 provides for stabilizing the sleeve member 120 with the boat pedestal in addition to providing cushioning between the sleeve member 120 and the boat deck 22. In various embodiments, the spacer is made from rubber, plastic, or polyurethane. The bushing 128 is typically made from rubber, synthetic rubber, polyurethane, and separates the upper end of the sleeve member 120 from the underside of the boat seat 40. The bushing 128 provides for isolating and vibrations and other movement differences between the boat seat 40 and the boat seat accessory stand 100.

In one embodiment, the sleeve member 120 includes an adjustment screw 150 for securing the sleeve member 120 to the boat seat pedestal. The adjustment screw 150 includes a handle and a threaded screw that is situated midway along the upright length of the sleeve member 122 and opposite the main support member 110. The adjustment screw 150 is tightened through a hole in the sleeve member 122 and into the boat seat pedestal. Tightening the adjustment screw 150 secures the boat seat accessory stand 100 to the boat seat pedestal so that the boat seat accessory stand 100 rotates with the boat seat 40 as the fisherman 20 turns or rotates the boat seat 40. Of course, the adjustment screw 150 can also remain unsecured (unscrewed), thus allowing for the boat seat accessory stand 100 to rotate freely and independent of the boat seat 40.

In one embodiment, the main support member 110 of the boat seat accessory stand 100 includes a lower support opening 112 and an attachment opening 114. In one typical embodiment, an umbrella 30 is attachable to the boat seat accessory stand 100 via inserting the umbrella stand section 32 into the attachment opening 114 at the upper end of the main support member 110. The main support member 110 includes an adjustment screw 150 near the upper end of the main support member 110. Tightening the adjustment screw 150 secures the umbrella stand section 32 within the main support member 110. In one embodiment, the umbrella stand section 32 is adjustable vertically along the inside of the tubular structure of the main support member 110 so that the adjustment screw 150 is adjusted into the tube of the umbrella stand 32 to hold the umbrella 30 in place. In another embodiment, the umbrella stand 32 may have a hole within its tubular structure into which the adjustment screw 150 extends for securing the umbrella stand 32 to the boat seat accessory stand 100.

It should be appreciated that the intent is for an umbrella stand 32 to be securable to the tubular structure of the main support member 110 of the boat seat accessory stand 100.

The umbrella 30 includes a pole type umbrella stand 32 that is attachable to the main support member 110 of the boat seat accessory stand 100. In the illustrated embodiment, the umbrella stand 32 is attachable to the boat seat accessory stand 100 via sliding the umbrella stand 32 inside the tubular structure of the main support member 110. The umbrella stand 32 is secured via an adjustment screw 50 as described above.

As noted above, in one embodiment, the main support member 110 is assembled as a hollow, tubular structure from a lightweight, structurally rigid material such as aluminum, stainless steel, steel, galvanized steel, plastic, or other suitable materials.

In one embodiment, the sleeve member 120 is a hollow, tubular structure having an opening of sufficient diameter along its length providing for a typical boat seat pedestal to extend entirely through the interior of the sleeve member 120.

The boat seat accessory stand 100 includes a lower brace member 130 and an upper brace member 140 that extend between the main support member 110 and the sleeve member 120 respectively. The lower brace member 130 and the upper brace member 140 are hexagonal structures that provide the structure and strength for supporting an umbrella 30 or other type accessory at a convenient location relative to the boat seat 40.

Respective ends of the lower brace member 130 are attached near the lower end of both the sleeve member 120 and the main support member 110. One end of the upper brace member 140 is attached near the upper end of the sleeve member 120 toward the location of a typical boat seat 40 when installed. The opposite end of the upper brace member 140 is attached at a corresponding distance upward from the lower end of the main support member 110 so that the lower brace member 130 and the upper brace member 140 are substantially parallel to each other in a standard or typical configuration.

As also noted above, in one embodiment, the lower brace member 130 and the upper brace member 140 are assembled as hollow, hexagonal structures from a lightweight, structurally rigid, material such as aluminum, stainless steel, steel, galvanized steel, plastic, or other suitable materials. The hexagonal structures of the lower brace member 130 and the upper brace member 140 provide for greater strength in the horizontal support between the vertical cylindrical structures of the main support member 110 and the sleeve member 120.

In the illustrated embodiment, the main support member 110, the sleeve member 120, the lower brace member 130, and the upper brace member 140 are assembled as a single piece structure from a suitable material as described above to form a boat seat accessory stand 100. In one embodiment, the lower brace member 130 and the upper brace member 140 are welded at each end respectively to the main support member 110 and to the sleeve member 120. In various embodiments, the boat seat accessory stand 100 is assembled from various and/or separate pieces as necessary or desired for the particular structure. That is, the boat seat accessory stand 100 need not be limited to a one piece structure and the main support member 110, the sleeve member 120, the lower brace member 130, and the upper brace member 140 may all be separate pieces that are attached together through various means as known in the art.

Figure 4:
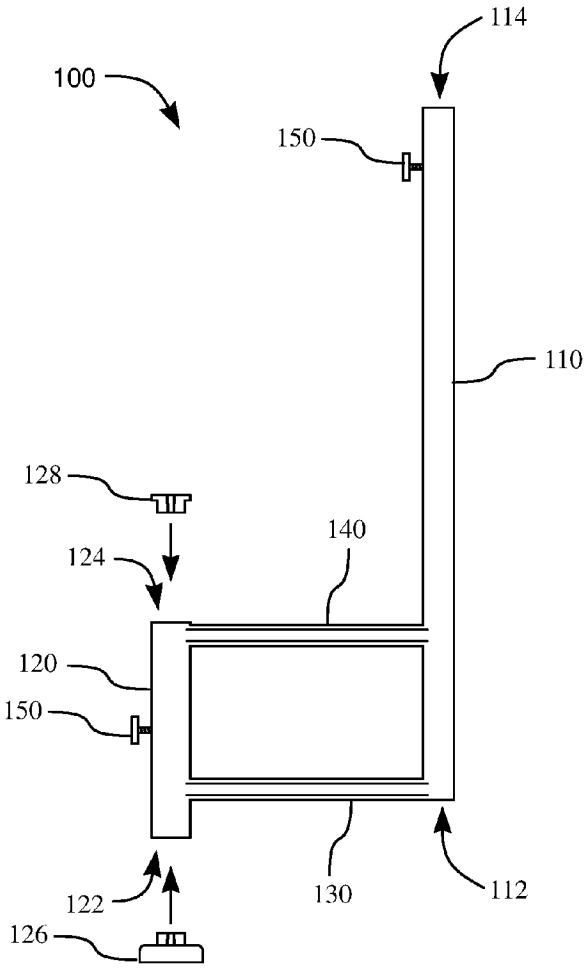
FIG. 4 is a front view of the boat seat accessory stand.
Figure 5:
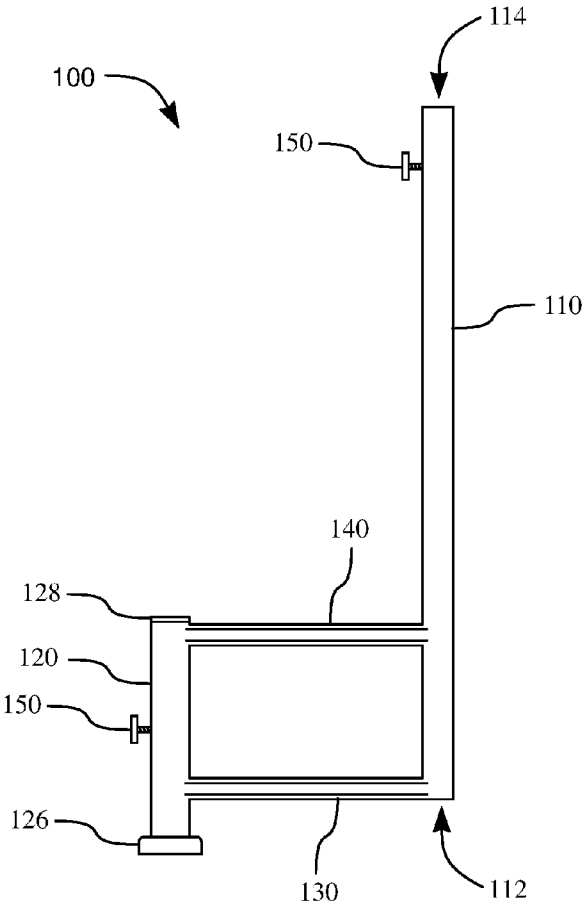
FIG. 5 is a rear view of the boat seat accessory stand.
Figure 6:
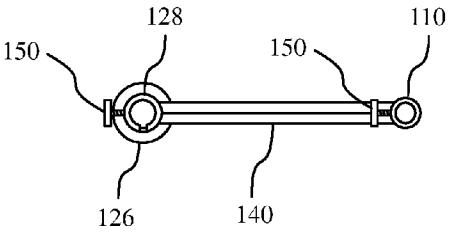
FIG. 6 is a top view of the boat seat accessory stand.
Figure 7:
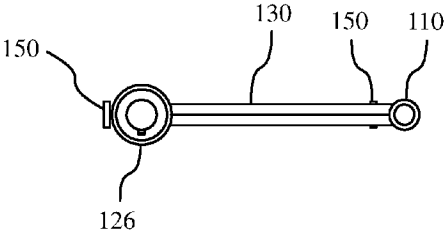
FIG. 7 is a bottom view of the boat seat accessory stand.
Figure 5:
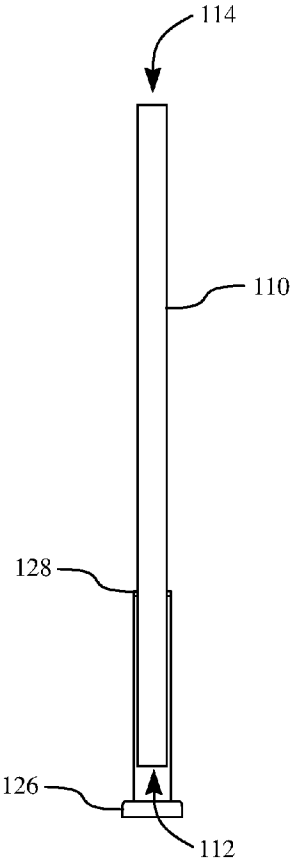
Figure 4:
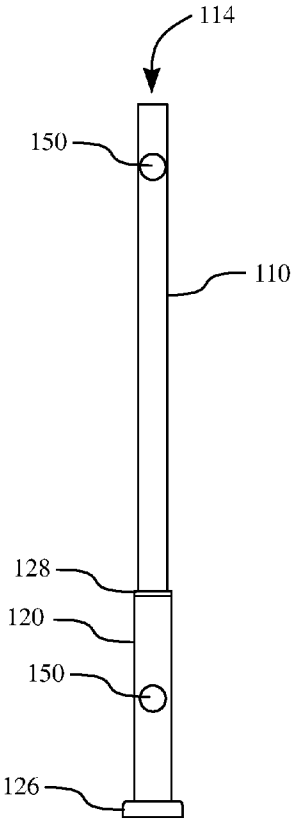

FIG. 4 is a front view of the boat seat accessory stand 100, FIG. 5 is a rear view of the boat seat accessory stand 100, FIG. 6 is a top view of the boat seat accessory stand 100, and FIG. 7 is a bottom view of the boat seat accessory stand 100.

In the illustrated embodiment, the sleeve member 120 is a hollow, tubular structure having an opening of sufficient diameter along its length providing for a typical boat seat pedestal to extend entirely through the interior of the sleeve member 120. The hollow opening of the sleeve member 120 includes an upper sleeve opening 122 as seen in the top view of FIG. 6, and a lower sleeve opening 124 as seen in the bottom view of FIG. 7. The hollow opening of the sleeve member 120 is of sufficient diameter that a pedestal of a typical boat seat can extend through the entire length of the sleeve member 120 opening. In various embodiments, the length of the sleeve member 120 is less than the length of the pedestal of a standard or typical pedestal mount boat seat.

As noted above, the main support member 110 includes an adjustment screw 150 for securing a separate tubular structure such as an umbrella stand 32 within the main support structure 110. In other embodiments, the umbrella stand 32 can be secured within the main support member 110 via any of various pin securing mechanisms known in the art, such as a locking pin 114, a push button, or a spring loaded detent, for example. It should be appreciated that the intent is for an umbrella stand to be securable to the rod extension 112 of the main support member 110 of the boat seat accessory stand 100 through any of various type locking or securing mechanisms known in the art. That is, the ability to attach a tubular structure having an opening to a separate tubular structure having a rod or other type extension via various fastening or securing type mechanisms is intended to be within the scope of this disclosure.

In one embodiment, the lower support opening 112 provides for drainage and to prevent water or other liquids from being trapped within the boat seat accessory stand 100. In other embodiments, the lower support opening 112 is a small opening within the end of the lower support opening 112 for allowing water or liquid to drain from the boat seat accessory stand 100 while maintaining a relatively closed structure. The lower support opening 112 prevents water from building up in the lower brace member 130 and/or the main support structure 110 in the event that the boat seat accessory stand 100 is oriented so that the corner where these portions intersect is the lowest point of the boat seat accessory stand 100 in a given circumstance. The lower support opening 112 may be any suitable size or shape for allowing water to drain through the boat seat accessory stand 100 and prevent buildup.

Figure 8:
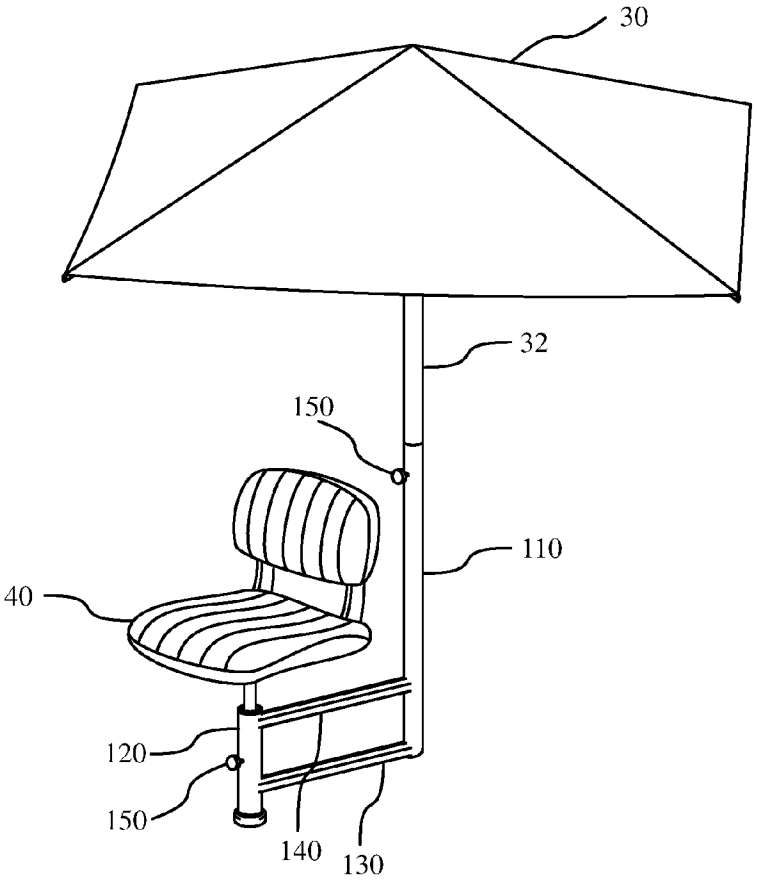
FIG. 8 is a perspective view of the boat seat accessory stand and an attached umbrella.

FIG. 8 is a perspective view of the boat seat accessory stand 100 and an attached umbrella 30. The umbrella 30 is a standard umbrella such as is used for providing shade and is similar to those found and/or utilized on beaches and lakes. The umbrella 30 includes a pole type umbrella stand 32 that is attachable to the main support member 110 of the boat seat accessory stand 100. In the illustrated embodiment, the umbrella stand 32 is attachable to the boat seat accessory stand 100 via sliding the umbrella stand 32 within the attachment opening 114 of the main support member 110. The umbrella stand 32 is secured via an adjustment screw 150 as described above.

As illustrated in the embodiment of FIG. 8, the boat seat 40 includes a pedestal mount that extends through the sleeve member 120. The pedestal mount is then attached to a boat deck 22 via any of the standard methods known in the art for attaching a pedestal mount to a boat or deck.

Figure 9:
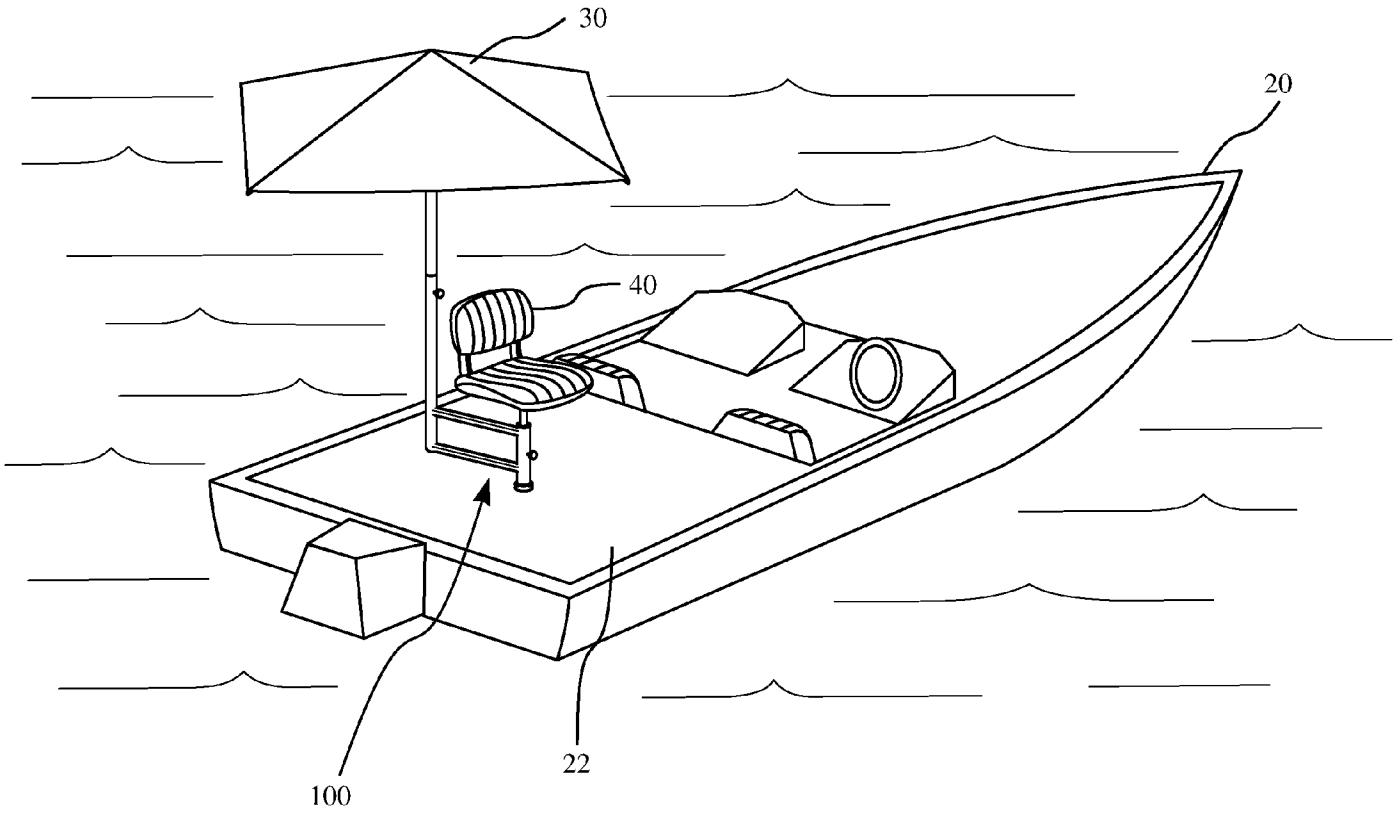
FIG. 9 is a perspective view of the boat seat accessory stand and an attached umbrella secured to a boat.

FIG. 9 is a perspective view of the boat seat accessory stand 100 and an attached umbrella 30 secured to a boat deck 22 of a boat 20. It should be apparent that the boat seat accessory stand 100 provides for rotating the attached umbrella with or separate from the boat seat 40. That is the boat seat accessory stand 100 may be rotated so that the umbrella provides for shade to the fisherman at the best desired orientation.

The boat 20 can be of any conventional construction that includes a pedestal mount boat seat. In the illustrated embodiment, the boat is an open fishing boat having a raised rear deck 22 or platform for attaching a boat seat 40.

From the foregoing description, it will be recognized by those skilled in the art that a boat seat accessory stand 100 including a main support member 110, a sleeve member 120, a lower brace member 130, and an upper brace member 140, capable of supporting an umbrella 30 to shade its user has been provided. The boat accessory stand 100 is attachable to a boat seat 40 via merely extending the mount pedestal of the boat seat 40 through the sleeve member 120 and attaching the mount pedestal to the boat deck 22 in typical fashion.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A boat seat accessory stand for securing to a boat seat pedestal to support a cylindrical body accessory, the stand comprising:

a first tubular member of first length and a second tubular member of second length, each being cylindrical and hollow, open at each end, and substantially parallel to each other, the second length substantially greater than the first length;

a first support brace and a second support brace of substantially equal length, being substantially parallel and hexagonal along their respective lengths, and extending between and attached to each of the first tubular member and the second tubular member, the first support brace attaching adjacent one end of the second tubular member and near a corresponding end of the first tubular member, the second support brace attaching near one end of the first tubular member;

the first tubular member being a sleeve for receiving the boat seat pedestal within the first tubular member, and having length less than the second length;

a first hole within the first tubular member, the first hole being centric along the first length, for receiving a first adjustable fastener capable of securing the first tubular member to the boat seat pedestal;

the second tubular member having an end opening at an end distal from the first support brace, the second support brace being attached between the first support brace and the end opening, the end opening for receiving an accessory with a cylindrical body attachment; and a second hole within the second tubular member, the second hole situated near the end opening, for receiving a second adjustable fastener capable of securing the second tubular member to the cylindrical body attachment of the accessory;

wherein the boat seat pedestal attaches to a deck on a boat so that the boat seat accessory stand provides for rotation of the second tubular member and accessory with rotation of the boat seat.

2. The boat seat accessory stand of claim 1, wherein the first adjustable fastener is an adjustment screw that tightens to the boat seat pedestal.

3. The boat seat accessory stand of claim 1, wherein the second adjustable fastener is an adjustment screw that tightens to the cylindrical body attachment of the accessory.

4. The boat seat accessory stand of claim 1, further comprising a spacer insert within an end of the first tubular member to provide stabilization against a boat deck.

5. The boat seat accessory stand of claim 1, further comprising a bushing insert within an end of the first tubular member to provide cushion for a boat seat assembly.

6. A boat seat accessory stand for securing to a boat seat pedestal to support a cylindrical body accessory, the stand comprising:

a first tubular member of first length and a second tubular member of second length, each being cylindrical and hollow, open at each end, and substantially parallel to each other, the second length substantially greater than the first length;

a first support brace and a second support brace of substantially equal length, being substantially parallel hollowed hexagon structures, and extending between and attached to each of the first tubular member and the second tubular member, the first support brace attaching adjacent one end of the second tubular member and near a corresponding end of the first tubular member, the second support brace attaching near one end of the first tubular member;

the first tubular member being a sleeve for receiving the boat seat pedestal within the first tubular member, and having length less than the second length;

a first hole within the first tubular member, the first hole being centric along the first length, for receiving a first adjustment screw for securing the first tubular member to the boat seat pedestal;

the second tubular member having an end opening at an end distal from the first support brace, the second support brace being attached between the first support brace and the end opening, the end opening for receiving an accessory with a cylindrical body attachment; and a second hole within the second tubular member, the second hole situated near the end opening, for receiving a second adjustment screw for securing the second tubular member to the cylindrical body attachment of the accessory;

wherein the boat seat pedestal attaches to a deck on a boat so that the boat seat accessory stand provides for rotation of the second tubular member and accessory with rotation of the boat seat.

7. The boat seat accessory stand of claim 6, further comprising a spacer insert within an end of the first tubular member to provide stabilization against a boat deck.

8. The boat seat accessory stand of claim 6, further comprising a bushing insert within an end of the first tubular member to provide cushion for a boat seat assembly.

9. A boat seat accessory stand for securing to a boat seat pedestal to support a cylindrical body accessory, the stand comprising:

a first tubular member of first length and a second tubular member of second length, each being cylindrical and hollow, open at each end, and substantially parallel to each other, the second length substantially greater than the first length;

a first support brace and a second support brace of substantially equal length, being substantially parallel and hexagonal along their respective lengths, and extending between and attached to each of the first tubular member and the second tubular member, the first support brace attaching adjacent one end of the second tubular member and near a corresponding end of the first tubular member, the second support brace attaching near one end of the first tubular member;

the first tubular member being a sleeve for receiving the boat seat pedestal within the first tubular member, having length less than the second length, and including a spacer insert within a first end of the first tubular member to provide stabilization against a boat deck, and including a bushing insert within a second end of the first tubular member to provide cushion for a boat seat assembly;

a first hole within the first tubular member, the first hole being centric along the first length, for receiving a first adjustment screw for securing the first tubular member to the boat seat pedestal;

the second tubular member having an end opening at an end distal from the first support brace, the second support brace being attached between the first support brace and the end opening, the end opening for receiving an accessory with a cylindrical body attachment; and a second hole within the second tubular member, the second hole situated near the end opening, for receiving a second adjustment screw for securing the second tubular member to the cylindrical body attachment of the accessory;

wherein the boat seat pedestal attaches to a deck on a boat so that the boat seat accessory stand provides for rotation of the second tubular member and accessory with rotation of the boat seat.

* * * * *